US011267257B2

(12) United States Patent
Takami

(10) Patent No.: US 11,267,257 B2
(45) Date of Patent: Mar. 8, 2022

(54) LABEL PRINTER

(71) Applicant: SEIKO EPSON CORPORATION, Tokyo (JP)

(72) Inventor: Toru Takami, Shiojiri (JP)

(73) Assignee: Seiko Epson Corporation, Tokyo (JP)

( * ) Notice: Subject to any disclaimer, the term of this patent is extended or adjusted under 35 U.S.C. 154(b) by 54 days.

(21) Appl. No.: 16/925,568

(22) Filed: Jul. 10, 2020

(65) Prior Publication Data

US 2021/0008897 A1 Jan. 14, 2021

(30) Foreign Application Priority Data

Jul. 11, 2019 (JP) ..... JP2019-128888

(51) Int. Cl.

| | |
|---|---|
| ***B41J 3/407*** | (2006.01) |
| ***B41J 29/393*** | (2006.01) |
| ***B65H 20/02*** | (2006.01) |
| ***B65C 9/00*** | (2006.01) |

(52) U.S. Cl.

CPC ..... *B41J 3/4075* (2013.01); *B41J 29/393* (2013.01); *B65C 9/0006* (2013.01); *B65H 20/02* (2013.01); *B65C 2009/0009* (2013.01); *B65H 2301/44318* (2013.01); *B65H 2301/51122* (2013.01); *B65H 2515/32* (2013.01)

(58) Field of Classification Search

CPC ..... B41J 3/4075; B65C 9/0006; B65C 20/02; B65C 2009/0009; B65H 2301/5122; B65H 2515/32; B65H 2701/192

See application file for complete search history.

(56) References Cited

U.S. PATENT DOCUMENTS

| | | | | |
|---|---|---|---|---|
| 5,718,525 | A * | 2/1998 | Bruhnke | B41J 3/4075 400/120.16 |
| 5,730,816 | A * | 3/1998 | Murphy | B65C 9/0006 156/229 |
| 2018/0001663 | A1* | 1/2018 | Takami | B41J 3/4075 |
| 2019/0061388 | A1 | 2/2019 | Kasai | |
| 2021/0039914 | A1* | 2/2021 | Takami | B65C 9/0006 |

FOREIGN PATENT DOCUMENTS

| | | | |
|---|---|---|---|
| JP | 2019-043561 | | 3/2019 |
| KR | 100733769 | B1 * | 7/2007 |

* cited by examiner

*Primary Examiner* — Julian D Huffman
(74) *Attorney, Agent, or Firm* — Workman Nydegger

(57) ABSTRACT

A label printer includes a print head configured to perform printing on a label sheet, a transporting roller configured to transport the label sheet downstream, a peeling roller configured to transport a backing sheet in a direction different from a travelling direction of a label to peel the label from the backing sheet, and a control unit configured to control rotation of the transporting roller and rotation of the peeling roller, wherein a maximum friction force between the transporting roller and the label sheet are set such that the maximum friction force between the peeling roller and the backing sheet is not greater than a transport force of the peeling roller so as to make a transport error of the label sheet by the transporting roller within an acceptable value.

3 Claims, 7 Drawing Sheets

LABEL PRINTER

The present application is based on, and claims priority from JP Application Serial Number 2019-128888, filed Jul. 11, 2019, the disclosure of which is hereby incorporated by reference herein in its entirety.

BACKGROUND

1. Technical Field

The present disclosure relates to a label printer.

2. Related Art

A label printer is disclosed in which printing is performed with a label sheet including a label attached on a backing sheet as a printing medium, and the printed label is peeled from the backing sheet by a peeling unit downstream of a printing unit (see JP-A-2019-43561). The peeling unit includes a peeling roller that transports the backing sheet to peel the label from the backing sheet.

In the label printer, the peeling roller and a transporting roller that transports the label sheet at a position upstream of the printing unit are rotated by the powers of respective different motors. In such a configuration, the transport force of the backing sheet by the peeling roller may be increased more than expected due to temporary disturbances in the current value supplied to the motor and individual variation among the motors. When the transport force of the peeling roller for the backing sheet excessively increases, slippage occurs between the transporting roller and the label sheet, and the transport accuracy of the label sheet by the transporting roller may be reduced. Such reduction in the transport accuracy degrades the printing quality.

SUMMARY

A label printer includes a print head configured to perform printing on a label sheet including a label attached to a backing sheet, a transporting roller disposed upstream of the print head in a transport path of the label sheet, and configured to rotate in a state where the transporting roller is in contact with the label sheet to transport the label sheet downstream in the transport path, a peeling roller disposed downstream of the print head in the transport path, and configured to rotate in a state where the peeling roller is in contact with the backing sheet, the peeling roller being configured to transport the backing sheet in a direction different from a travelling direction of the label to peel the label from the backing sheet, and a control unit configured to control rotation of the transporting roller and rotation of the peeling roller, wherein the control unit controls a current value supplied to a peeling motor such that a transport force of the peeling roller for transporting the backing sheet is not smaller than a minimum force required for peeling the label and is not greater than a maximum friction force between the peeling roller and the backing sheet, the peeling motor being configured to rotate the peeling roller, and the maximum friction force between the peeling roller and the backing sheet and a maximum friction force between the transporting roller and the label sheet are set such that the maximum friction force between the peeling roller and the backing sheet is not greater than a transport force of the peeling roller so as to make a transport error of the label sheet by the transporting roller within an acceptable value.

DESCRIPTION OF EXEMPLARY EMBODIMENTS

An embodiment of the present disclosure will be described below with reference to the accompanying drawings. The drawings are merely exemplification for describing this embodiment. The drawings are exemplification, and therefore may not be accurate in ratio, may be inconsistent with one another, and may be partially omitted.

1. Device Configuration

Figure 1:
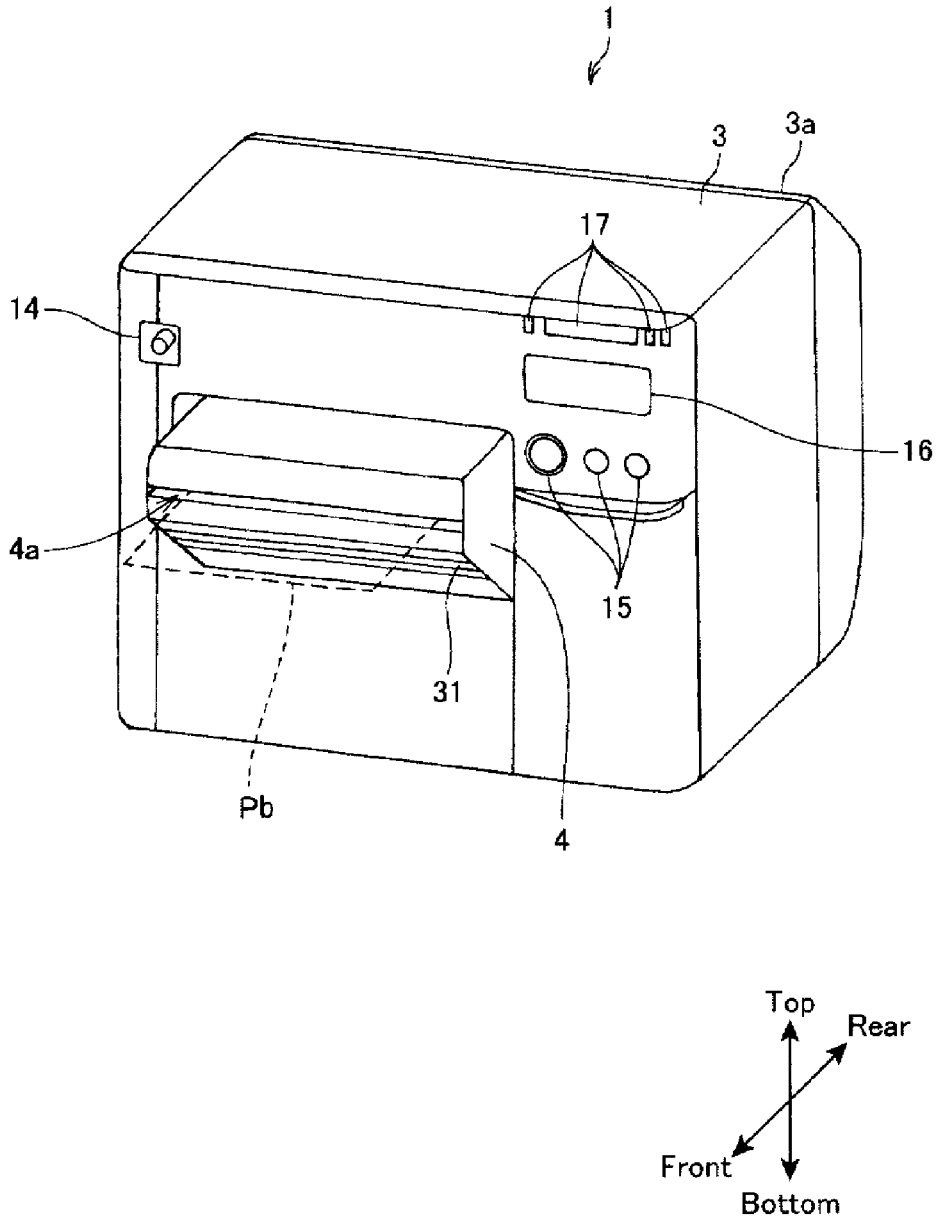
FIG. 1 is an external perspective view of a label printer.

FIG. 1 is an external perspective view illustrating a label printer 1 according to this embodiment.

Figure 2:
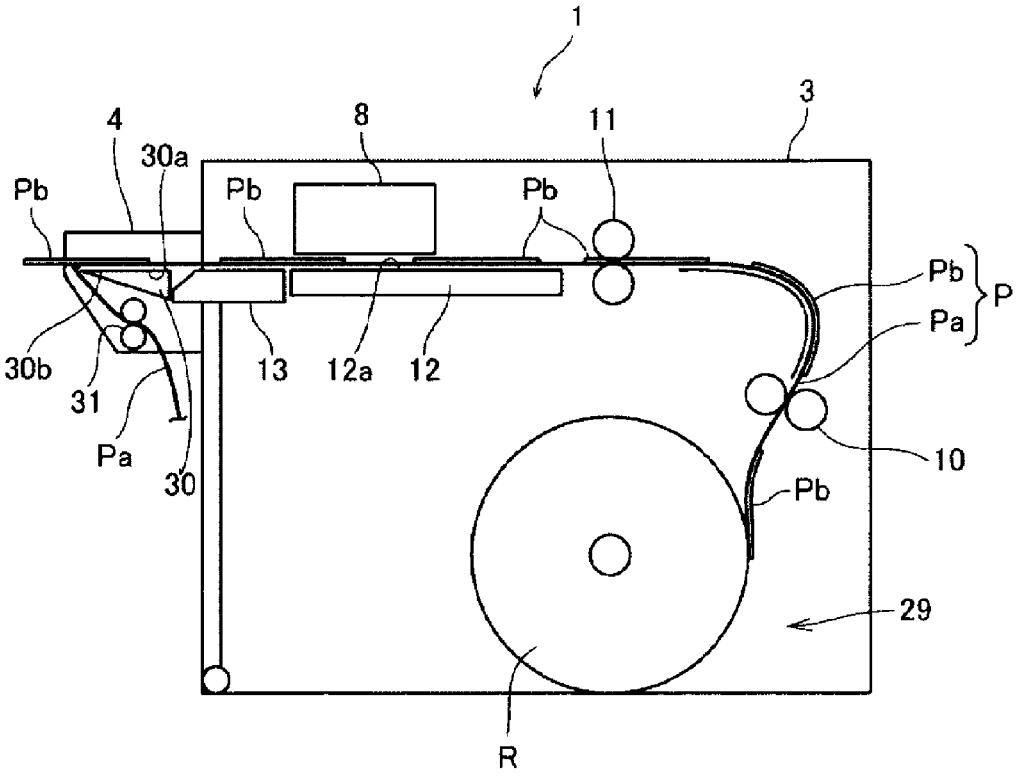
FIG. 2 is a schematic diagram illustrating a configuration of the label printer.

FIG. 2 is a schematic diagram illustrating a configuration of the label printer 1, and illustrates a schematic configuration of an interior of the label printer 1. Hereinafter, for convenience, the directions with respect to the label printer 1 will be described as "top", "bottom", "front", and "rear" illustrated in FIG. 1. The label printer 1 is a printer for printing characters, images, graphics, and the like by an ink-jet method using a label sheet P as a printing medium.

The label sheet P includes a backing sheet Pa and a plurality of labels Pb. The backing sheet Pa is a strip-shaped continuous paper. The surface of the backing sheet Pa is provided with releasability, and the labels Pb each of which is cut in a predetermined size are attached at an equal interval in the longitudinal direction of the backing sheet Pa. The material of the backing sheet Pa and the label Pb may be paper or a material other than paper. The backing sheet Pa may be referred to as a base member. The label sheet P is set in the label printer 1 as a roll sheet R wound in a roll shape.

The label printer 1 includes a printing unit 3 as a main body of the label printer 1, and a peeling unit 4. The peeling unit 4 may be integrally formed with the printing unit 3 on the front surface of the label printer 1, or may be a part that is detachably provided on the front surface of the printing unit 3. The peeling unit 4 is a device that performs a process of peeling the label Pb from the backing sheet Pa for the label sheet P printed by the printing unit 3, and is referred to also as a peeler. At the front surface of the peeling unit 4, an ejection port 4*a* through which the printed label sheet P or the label Pb that has been peeled from the backing sheet Pa is ejected is open. The label printer 1 can perform a non-peeling mode in which the printed label sheet P with the label Pb attached on the backing sheet Pa is ejected from the ejection port 4*a*, and a peeling mode in which the printed label Pb peeled from the backing sheet Pa is ejected from the ejection port 4*a*. In this embodiment, the description will be made based on the peeling mode.

The printing unit 3 has a configuration in which a function unit including a print head 8 is housed in a case 3*a* having a box-like shape. As illustrated in FIG. 1, a power switch 14, a plurality of operation buttons 15, a display 16, a plurality of lamps 17, and the like are provided in the surface of the case 3*a*. The power switch 14 is a switch for on/off of the power of the label printer 1. The operation button 15 is a button for receiving various operations performed by a user for the label printer 1. The display 16 is configured with an LCD or the like, and displays various information such as an operating state of the label printer 1. The display 16 may have a function of a touch panel that receives user operations. The lamp 17 includes a light source such as an LED, and turns on or off, or blinks in accordance with the operating state of the label printer 1 or the like so as to function as an indicator.

The printing unit 3 performs printing on each label Pb of the label sheet P with each function unit including the print head 8 housed in the case 3*a* based on print data and commands transmitted from a host computer (not illustrated). In addition, the printing unit 3 transports the label sheet P along the transport path of the label sheet P. Hereinafter, the upstream and downstream transporting paths are referred to simply as upstream and downstream.

As illustrated in FIG. 2, the printing unit 3 includes a housing 29, a feeding roller 10, a transporting roller 11, a platen 12, a guide 13, and a print head 8. The transporting roller 11 and the feeding roller 10 may be collectively referred to as a transport unit. The housing 29 is a space for housing the roll sheet R, and the label sheet P is fed from the roll sheet R set in the housing 29. The feeding roller 10, which is composed of a pair of rollers facing each other, pulls the label sheet P fed from the roll sheet R and transports the label sheet P downstream. The transporting roller 11, which is composed of a pair of rollers facing each other, sandwiches the label sheet P transported by the feeding roller 10, and transports the label sheet P toward the downstream print head 8.

The transporting roller 11 is coupled, directly or with a gear, a belt or the like therebetween, to a transport motor 21 described below, and is rotated by the power of the transport motor 21. The feeding roller 10 is coupled to the transport motor 21 together with the transporting roller 11 and is rotated by the power of the transport motor 21. Note that the feeding roller 10 may be configured to be driven by a motor (not illustrated) that is different from the transport motor 21. In addition, the feeding roller 10 is not an essential configuration.

The platen 12 is disposed downstream of the transporting roller 11 in the transport path of the label sheet P. A platen surface 12*a*, which is the top surface of the platen 12, supports the label sheet P from below by making contact with the backing sheet Pa of the label sheet P. It is also possible to adopt a configuration in which the platen surface 12*a* includes a plurality of intake holes, and air is sucked from the intake holes into the platen 12 at the timing of printing at the print head 8 such that the label sheet P adheres to the platen surface 12*a*.

The print head 8 is disposed in such a manner as to face the platen surface 12*a*. The print head 8 includes a nozzle row (not illustrated) corresponding to one or more ink colors, and discharges ink from nozzles constituting each nozzle row. The ink discharged by the nozzle is also referred to as a dot. The print head 8 performs printing on the label Pb by discharging ink to the label Pb located on the platen surface 12*a* based on print data. The label sheet P printed by the print head 8 is transported to the downstream peeling unit 4 by the transporting roller 11.

The guide 13 is disposed downstream of the print head 8. The guide 13 supports from below the label sheet P printed by the print head 8 between the platen 12 and the front surface of the printing unit 3. The label sheet P is transported toward the peeling unit 4 through the guide 13.

The peeling unit 4 includes a peeling member 30 and a peeling roller 31. The peeling member 30 is located downstream of the print head 8 of the printing unit 3. The peeling member 30 includes a guide surface 30*a* that supports the label sheet P from below by making contact with the backing sheet Pa of the label sheet P, and an acute-angled peeling edge 30*b* formed at the tip of the guide surface 30*a*. The label sheet P guided by the guide 13 is transported over the guide surface 30*a* of the peeling member 30.

The peeling roller 31 is composed of a pair of rollers facing each other, and transports the backing sheet Pa in a sandwiching manner. The peeling roller 31 is coupled, directly or with a gear, a belt or the like therebetween, to the peeling motor 34 described below, and is rotated by the power of the peeling motor 34.

When the label printer 1 is operated in the peeling mode, the user performs an operation of sandwiching the backing sheet Pa of the label sheet P by the peeling roller 31 prior to the start of the printing. The peeling roller 31 is disposed below the peeling member 30 and transports the backing sheet Pa downward in a sandwiching manner. The backing sheet Pa of the label sheet P transported through the guide surface 30*a* is bent at the peeling edge 30*b* and pulled downward by the peeling roller 31. With the pulling force of the peeling roller 31, the label Pb is separated and peeled from the backing sheet Pa at the peeling edge 30*b*. The peeled label Pb protrudes out of the ejection port 4*a*. The label Pb protruding from the ejection port 4*a* is collected by the user. On the other hand, the backing sheet Pa transported by the peeling roller 31 in a direction different from the label Pb is ejected to the lower side of the peeling roller 31 in the example of FIG. 2.

With the above-described configuration, the feeding roller 10, the transporting roller 11, the platen 12, and the guide 13 form the transport path of the label sheet P in the printing unit 3. In addition, it can be said that the guide surface 30*a* and the peeling edge 30*b* of the peeling member 30 and the peeling roller 31 also form a part of the transport path.

Figure 3:
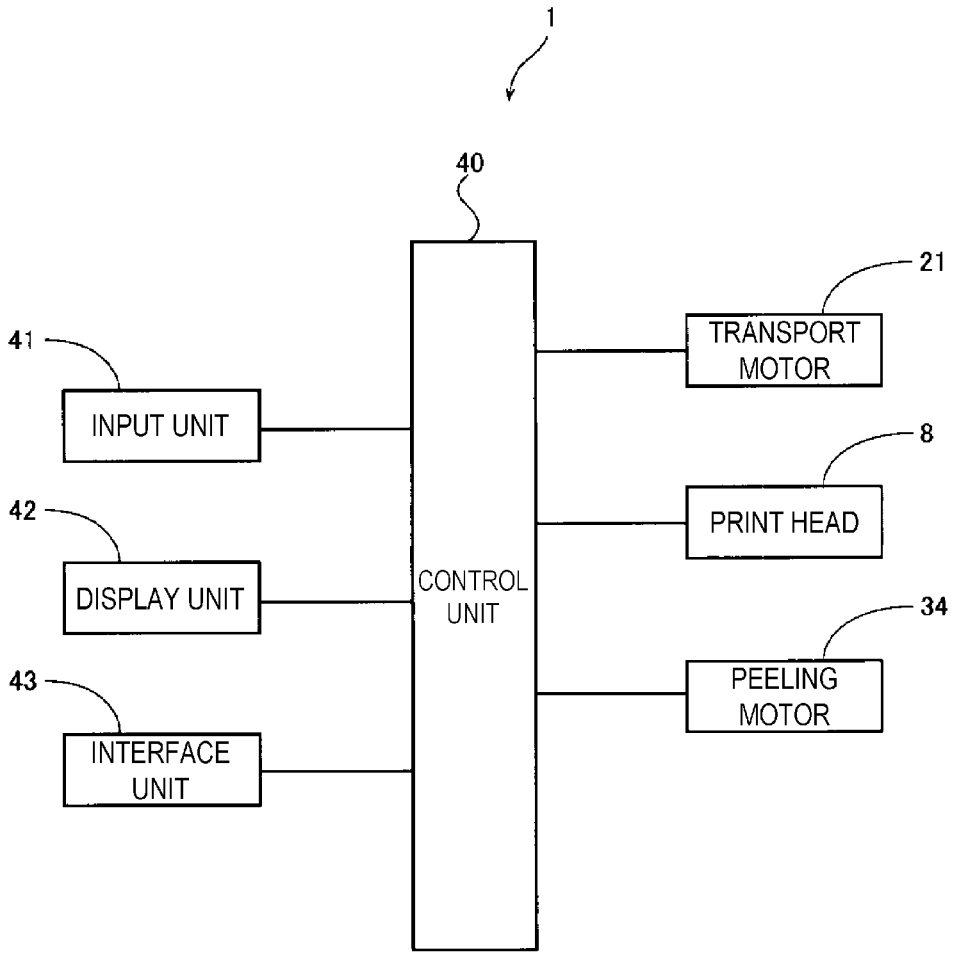
FIG. 3 is a block diagram illustrating a control system of the label printer.

FIG. 3 is a block diagram illustrating a control system of the label printer 1. The label printer 1 includes a control unit 40 that controls each part of the printing unit 3 and the peeling unit 4. In the control unit 40, a processor such as a CPU and a microcomputer controls each part of the label printer 1 by performing arithmetic processing in accordance with a program stored in a ROM or other memory, using a RAM as a work area.

The label printer 1 includes an input unit 41, a display unit 42, and an interface unit 43, and each of the components is coupled to the control unit 40. The control unit 40 is coupled to the print head 8, the transport motor 21, and the peeling motor 34 as operating units to be controlled. The print head 8, the transport motor 21, and the peeling motor 34 may each be coupled to the control unit 40 through a drive circuit that supplies power for driving. The control unit 40 controls each operating unit to perform transporting and printing of the label sheet P.

The input unit 41 detects operations on the operation button 15 and the touch panel, and outputs a signal corresponding to the details of the detected operation to the control unit 40. The display unit 42 drives the display 16 and the lamp 17 in accordance with the control of the control unit 40 such that the display 16 displays characters and images and that the lamp 17 turns on or blinks. The interface unit 43 is connected to a host computer (not illustrated) in a wired or wireless manner, and communicates with the host computer in accordance with the control of the control unit 40. The interface unit 43 receives commands and print data transmitted by the host computer and outputs the commands and print data to the control unit 40.

For the configuration of the label printer 1, the above-mentioned JP-A-2019-43561 may be appropriately referred to.

2. Setting and Control of Each Roller

Figure 4:
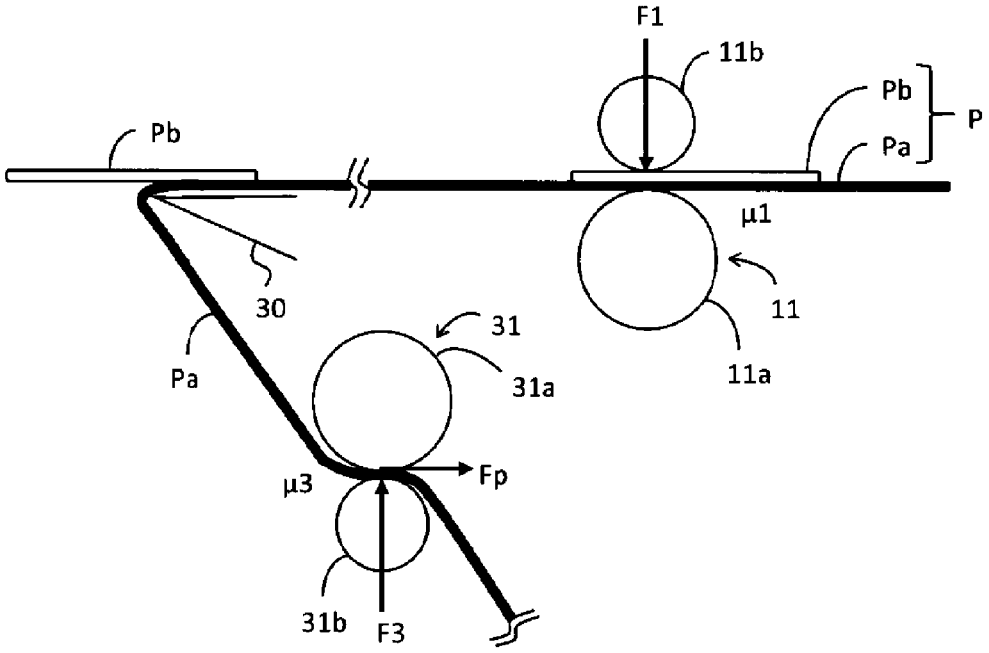
FIG. 4 is a drawing illustrating a partial range including a transporting roller and a partial range including a peeling roller.

FIG. 4 illustrates a partial range including the transporting roller 11 and a partial range including the peeling roller 31 in the label printer 1 from the same perspective as that of FIG. 2. In FIG. 4, most of the configuration illustrated in FIG. 2 is omitted.

The transporting roller 11 includes a first driving roller 11*a* and a first driven roller 11*b* that sandwich the label sheet P therebetween. The first driving roller 11*a* is rotated by the power of the transport motor 21. The first driven roller 11*b* is supported such that the first driven roller 11*b* is rotatable along with transport of the label sheet P by the rotation of the first driving roller 11*a*.

The peeling roller 31 includes a second driving roller 31*a* and a second driven roller 31*b* that sandwich the backing sheet Pa of the label sheet P therebetween. The second driving roller 31*a* is rotated by the power of the peeling motor 34. The second driven roller 31*b* is supported such that the second driven roller 31*b* is rotatable along with transport of the backing sheet Pa by the rotation of the second driving roller 31*a*.

In the transporting roller 11, the first driven roller 11*b* presses the first driving roller 11*a* with a force F1 in order to sandwich the label sheet P. Specifically, at the contact point with the label sheet P, the first driving roller 11*a* is pressed by the force F1 that is substantially perpendicular to the orientation of the label sheet P. The force F1 is described as a force per unit width (1 mm) that is obtained by dividing a pressing force of the first driven roller 11*b* on the first driving roller 11*a* by a width [mm] of the label sheet P. The unit of the force F1 is [gf/mm]. Each of forces F2, F3, F4 and Fp described below is also a force per unit width as with the F1, and the unit thereof is [gf/mm]. Note that the unit [gf/mm] is appropriately omitted in the following description. The width of the label sheet P is the width of the label sheet P in the direction orthogonal to the longitudinal direction of the long label sheet P, and is a predetermined value.

The static friction coefficient between the first driving roller 11*a* in contact with the backing sheet Pa of the label sheet P and the backing sheet Pa is $\mu 1$. Accordingly, when the force F1 is assumed as a normal force, the maximum friction force between the transporting roller 11 and the label sheet P can be represented as $\mu 1 \times F1$. The maximum friction force is also referred to as a maximum static friction force.

In this embodiment, a value of a transport force F2 of the peeling roller 31 so as to make the transport error of the label sheet P by the transporting roller 11 within an acceptable value is defined. The control unit 40 controls the transport amount of the label sheet P by the transporting roller 11 by controlling the driving of the transport motor 21. In a situation where a force that pulls downstream the label sheet P sandwiched by the transporting roller 11 is generated, slippage occurs between the transporting roller 11 and the label sheet P. This slippage causes an error, i.e., a transport error, in the transport amount of the label sheet P by the transporting roller 11.

The force of pulling downstream the label sheet P sandwiched by the transporting roller 11 is a force of the peeling roller 31 that pulls the label sheet P downstream, i.e., a transport force Fp of the peeling roller 31. When slack or deflection occurs in the backing sheet Pa in the transport path downstream of the transporting roller 11, it becomes difficult to peel the label Pb from the backing sheet Pa at the peeling unit 4. Therefore, the transport force Fp is required for reliably peeling the label Pb from the backing sheet Pa at the peeling unit 4.

When the amount of slippage is slight, almost no degradation of the printing quality, such as deviation of the dot hitting position to the label Pb, is caused. In view of this, in this embodiment, the above-described transport force F2 is defined by multiplying the maximum friction force $\mu 1 \times F1$ by a coefficient $\alpha$. That is, $F2=\alpha \times \mu 1 \times F1$ is defined. When the transport force Fp is not greater than the transport force F2, the transport error of the label sheet P by the transporting roller 11 is kept to a small amount, or within an acceptable value, which does not affect the printing quality. The coefficient $\alpha$ is a value greater than 0 and smaller than 1, and is, for example, $\alpha=0.2$. In this embodiment, the coefficient $\alpha$ is appropriately preset based on an experiment and/or an evaluation of the printing quality in accordance with the transport error of the transporting roller 11.

In the peeling roller 31, the second driven roller 31*b* presses the second driving roller 31*a* with a force F3 (gf/mm) in order to sandwich the backing sheet Pa. Specifically, at the contact point with the backing sheet Pa, the second driving roller 31*a* is pressed by the force F3 that is substantially perpendicular to the orientation of the backing sheet Pa. The static friction coefficient between the second driving roller 31*a* and the backing sheet Pa is $\mu 3$. Accordingly, when the force F3 is assumed as a normal force, the maximum friction force between the peeling roller 31 and the backing sheet Pa can be represented as $\mu 3 \times F3$.

The force F1 is set by adjusting an elastic member, such as a spring, that biases the first driven roller 11*b* toward the first driving roller 11*a*, for example. Likewise, the force F3 is set by adjusting an elastic member, such as a spring, that biases the second driven roller 31*b* toward the second driving roller 31*a*, for example. The static friction coefficient $\mu 1$ is set by selecting or adjusting the material, the surface state, and the like of the transporting roller 11. Likewise, the static friction coefficient $\mu 3$ is set by selecting or adjusting the material, the surface state, and the like of the peeling roller 31.

In such a situation, in the label printer 1, the maximum friction force $\mu 3 \times F3$ is set to a value not greater than the transport force F2. In other words, the values of F1, $\mu 1$, F3, and $\mu 3$ are set such that $\mu 3 \times F3 \leq F2$ in relation to the coefficient $\alpha$. In this embodiment, $\mu 3 < \mu 1$. In addition, preferably, the numerical range of the static friction coefficient $\mu 3$ is $0.1 \leq \mu 3 \leq 0$, for example.

The minimum transport force Fp required for peeling the label Pb by the peeling unit 4 is referred to as a transport force F4. The transport force F4 is smaller than the maximum friction force $\mu 3 \times F3$. That is, $F4 < \mu 3 \times F3 \leq F2 < \mu 1 \times F1$. The transport force F4 is set to an appropriate value based on an experiment in which the peeling roller 31 pulls the backing sheet Pa to peel the label Pb at the peeling unit 4 in the state where the maximum friction force μ1×F1 is fixed.

The transport force Fp changes in accordance with the current value supplied to the peeling motor 34 by the control unit 40 for driving the peeling motor 34. The peeling motor 34 is, for example, a DC motor. In response to increase in the current value supplied to the peeling motor 34, the torque of the peeling motor 34 increases, and the transport force Fp increases.

Here, when the transport force Fp generated by the peeling motor 34 is greater than the maximum friction force μ3×F3, slippage occurs between the second driving roller 31*a* and the backing sheet Pa, and the second driving roller 31*a*, i.e., the peeling roller 31 idles. Therefore, the control unit 40 controls the current to the peeling motor 34 such that the peeling roller 31 does not idle. Specifically, the control unit 40 controls the current value supplied to the peeling motor 34 such that the transport force Fp is not smaller than the transport force F4 and is not greater than μ3×F3.

Figure 5:
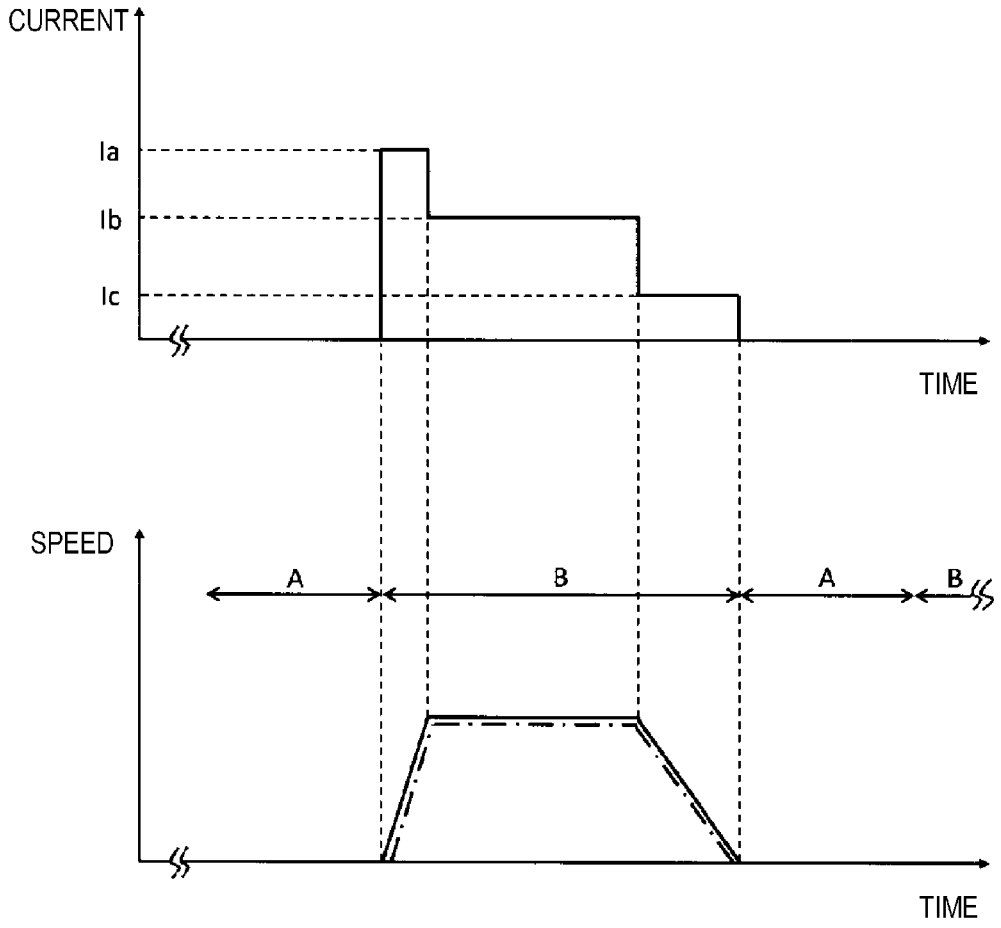
FIG. 5 is a diagram illustrating a change in a current value supplied to a peeling motor and a change in a rotational speed of the peeling roller.

In FIG. 5, the solid line graph on the upper side illustrates a change in the current value supplied to the peeling motor 34 by the control unit 40, and the solid line graph on the lower side illustrates a change in the rotational speed of the peeling roller 31. In FIG. 5, the upper graph and the lower graph are illustrated in such a manner that their time series, i.e., the horizontal axis, correspond to each other.

The processing period for the label sheet P of the label printer 1 that has selected the peeling mode is substantially divided into a printing period A and a transport period B. As illustrated in the lower graph of FIG. 5, the printing period A and the transport period B alternately occur. In the printing period A, the control unit 40 performs a single printing by driving the print head 8 without rotating each roller for transporting the label sheet P, such as the feeding roller 10, the transporting roller 11, and the peeling roller 31. The single printing is printing to the label Pb resting on the platen surface 12*a* among the labels Pb of the label sheet P.

In the transport period B, the control unit 40 rotates each roller for transporting the label sheet P by driving the transport motor 21 and the peeling motor 34 without driving the print head 8. In the transport period B, the control unit 40 performs the transport of the label sheet P by a predetermined distance required for setting, at a position on the platen surface 12*a*, the label Pb to be printed in the next printing period A. Along with the transport of the label sheet P in the transport period B, the label Pb after printing is peeled from the backing sheet Pa at the peeling unit 4.

The lower solid line graph in FIG. 5 has a trapezoidal shape, and therefore the transport period B of the peeling roller 31 is composed of an acceleration period for acceleration from a speed 0 to a predetermined speed, a constant-speed period for maintaining or substantially maintaining a predetermined speed, and a deceleration period for deceleration from the predetermined speed to the speed 0. The control unit 40 supplies a preset current value to the peeling motor 34 to rotate the peeling roller 31 by the power of the peeling motor 34 such that the rotational speed of the peeling roller 31 changes as illustrated in the lower solid line graph of FIG. 5.

Specifically, as illustrated on the upper side in FIG. 5, in the transport period B, the control unit 40 first supplies a predetermined current value Ia to the peeling motor 34 for the acceleration period to accelerate the peeling roller 31. Next, in the transport period B, the control unit 40 supplies a predetermined current value Ib, which is smaller than the current value Ia, to the peeling motor 34 for the constant-speed period to stabilize the rotational speed of the peeling roller 31. Next, in the transport period B, the control unit 40 supplies a predetermined current value Ic, which is smaller than the current value Ib, to the peeling motor 34 for the deceleration period to decelerate the peeling roller 31.

Figure 6:
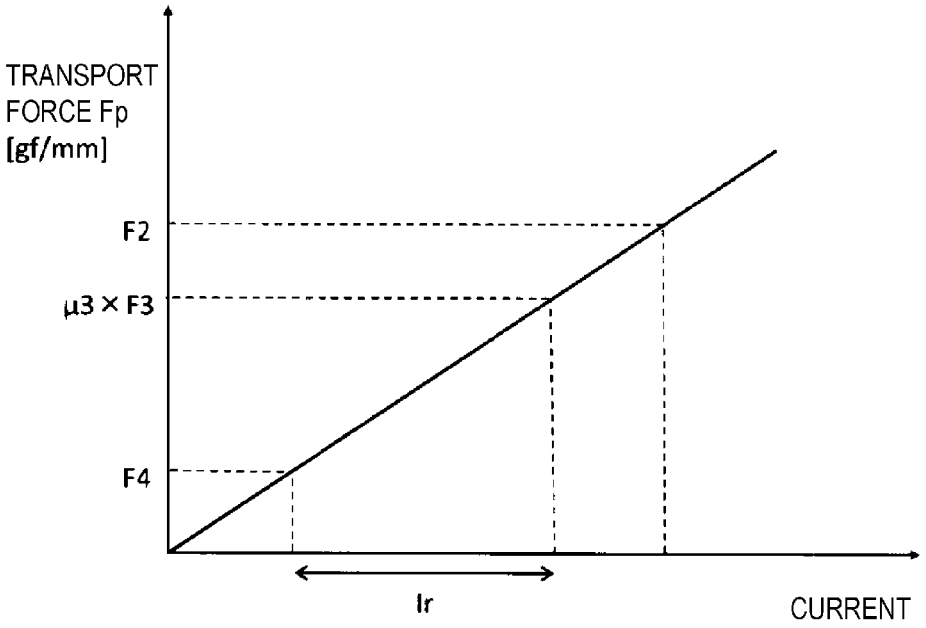
FIG. 6 is a diagram illustrating a relationship between a current value supplied to the peeling motor and a transport force of the peeling roller.

FIG. 6 is a graph illustrating a relationship between the current value supplied to the peeling motor 34 and the transport force Fp of the peeling roller 31. As described above, in this embodiment, the transport force F2, the maximum friction force μ3×F3, and the transport force F4 are set to F4<μ3×F3≤F2. In the example of FIG. 6, μ3×F3<F2. As the current value supplied to the peeling motor 34 increases, the transport force Fp increases. As described above, the control unit 40 controls the current to the peeling motor 34 such that the peeling roller 31 does not idle. Therefore, the control unit 40 supplies a current value of a range Ir corresponding to the maximum transport force Fp from the transport force F4 to the maximum friction force μ3×F3 to the peeling motor 34 in the transport period B. That is, the current values Ia, Ib, and Ic illustrated in the upper graph of FIG. 5 are current values that fall within the range Ir.

In the lower graph of FIG. 5, a change in the rotational speed of the transporting roller 11 is illustrated by a dot-dash line graph. The control unit 40 controls the driving of the transport motor 21 in the transport period B such that the rotational speed of the transporting roller 11 is substantially the same as a previously recognized rotational speed of the peeling roller 31 for each of the current values Ia, Ib and Ic, or such that the rotational speed of the transporting roller 11 is slightly lower than the rotational speed of the peeling roller 31. Although the control method of the transport motor 21 is not described in detail, the control unit 40 achieves the speed change of the transporting roller 11 as illustrated by the dot-dash line on the lower side in FIG. 5 by monitoring the rotation of the transport motor 21 via a rotary encoder (not illustrated) or the like, and by performing feedback control of the rotation of the transport motor 21 in accordance with the result of the monitoring, for example.

Here, FIGS. 5 and 6 illustrate a normal situation of this embodiment with regard to the control of the label printer 1. This normal situation may also be referred to as an ideal situation. For example, according to the upper graph of FIG. 5, in the normal control, the control unit 40 supplies the current values Ia, Ib, and Ic to the peeling motor 34 for the acceleration period, the constant-speed period, and the deceleration period of the peeling roller 31 in the transport period B. However, situations against such a normal situation are also anticipated.

Against the normal control, a current value greater than the current value Ia may be temporarily supplied to the peeling motor 34 in the acceleration period due to some disturbance, noise, and the like of the power supply system. When a current value greater than the current value Ia is supplied to the peeling motor 34, the transport force Fp greater than the maximum friction force μ3×F3 may be generated at the peeling roller 31. In addition, while FIG. 6 is a graph based on the peeling motor 34 having a designed normal performance, the actual performance of the motor varies from motor to motor. If the performance of the peeling motor 34 mounted on a certain label printer 1 is higher than the normal performance, the transport force Fp greater than the maximum friction force μ3×F3 may be generated at the peeling roller 31 when a current value falling within the range Ir is supplied.

Figure 7:
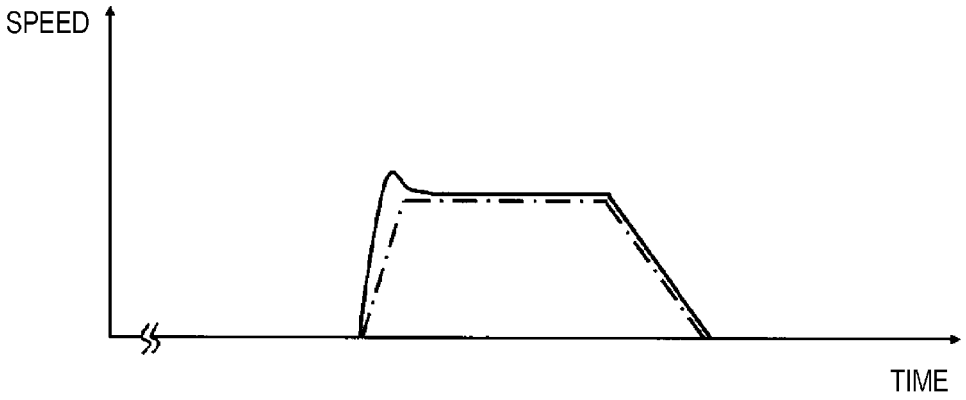
FIG. 7 is a diagram illustrating a change in the rotational speed of the peeling roller in a situation against a normal situation of the embodiment.

FIG. 7 illustrates a change in the rotational speed of the peeling roller 31 in a situation against the normal situation of this embodiment. In addition, in FIG. 7, the dot-dash line graph illustrates a change in the rotational speed of the transporting roller 11 as in the lower graph of FIG. 5. Assume that a current value greater than the current value Ia is temporarily supplied to the peeling motor 34 in the acceleration period of the peeling roller 31 due to the disturbance, noise, and the like described above. In such cases, the transport force Fp of the peeling roller 31 may exceed the maximum friction force μ3×F3, and the peeling roller 31 may idle. The rotational speed of the idling peeling roller 31 is higher than the speed in the acceleration period under the normal control illustrated in the lower graph in FIG. 5, and temporarily largely exceeds the rotational speed of the transporting roller 11 as illustrated in FIG. 7.

3. Summary

The label printer 1 of the embodiment includes the print head 8 configured to perform printing on the label sheet P including the label Pb attached to the backing sheet Pa, the transporting roller 11 disposed upstream of the print head 8 in the transport path of the label sheet P, and configured to rotate in a state where the transporting roller 11 is in contact with the label sheet P to transport the label sheet P downstream in the transport path, the peeling roller 31 disposed downstream of the print head 8 in the transport path, and configured to rotate in a state where the peeling roller 31 is in contact with the backing sheet Pa, the peeling roller 31 being configured to transport the backing sheet Pa in a direction different from the travelling direction of the label Pb to peel the label Pb from the backing sheet Pa, and the control unit 40 configured to control rotation of the transporting roller 11 and rotation of the peeling roller 31. The control unit 40 controls the current value supplied to the peeling motor 34 such that the transport force Fp of the peeling roller 31 for transporting the backing sheet Pa is not smaller than the minimum force (the transport force F4) required for peeling the label Pb and is not greater than the maximum friction force μ3×F3 between the peeling roller 31 and the backing sheet Pa, the peeling motor 34 being configured to rotate the peeling roller 31. Further, the maximum friction force μ3×F3 between the peeling roller 31 and the backing sheet Pa and the maximum friction force μ1×F1 between the transporting roller 11 and the label sheet P are set such that the maximum friction force μ3×F3 is not greater than the transport force F2 of the peeling roller 31 so as to make a transport error of the label sheet P by the transporting roller 11 within an acceptable value.

With the above-described configuration, the control unit 40 controls the current value to be supplied to the peeling motor 34 such that the transport force Fp of the peeling roller 31 falls within a range from the transport force F4 to the maximum friction force μ3×F3, and thus the control unit 40 provides the peeling roller 31 with the force required for peeling the label Pb without idling the peeling roller 31 with respect to the backing sheet Pa. Even when the control unit 40 performs the above-mentioned control, the transport force Fp may exceed the maximum friction force μ3×F3 due to disturbance and/or noise of the power supply system, the individual variation of the peeling motor 34, and the like. However, when the transport force Fp exceeds the maximum friction force μ3×F3, the peeling roller 31 idles. The idling of the peeling roller 31 means that the peeling roller 31 does not pull the backing sheet Pa with a force greater than the maximum friction force μ3×F3. The maximum friction force μ3×F3 does not exceed the transport force F2. Therefore, even when the transport force Fp of the peeling roller 31 temporarily exceeds the maximum friction force μ3×F3 against the control, the transport error exceeding the allowable value does not occur in the transport of the label sheet P by the transporting roller 11, and accordingly the printing quality is not substantially degraded. That is, according to this embodiment, both reliable peeling of the label Pb and maintenance of the printing quality can be achieved.

In addition, according to this embodiment, the static friction coefficient μ3 between the peeling roller 31 and the backing sheet Pa is smaller than the static friction coefficient μ1 between the transporting roller 11 and the label sheet P. Further, the static friction coefficient μ3 may be set to 0.1 μ3≤0.3.

With such configurations, the values μ1, F1, μ3, and F3 may be appropriately and easily set to configure the label printer 1.

According to this embodiment, a process achieved by the control unit 40 controlling the label printer 1 may be interpreted as an invention of a method and/or a program cooperating with hardware. The method of setting the values μ1, F1, μ3, and F3 disclosed in the embodiment may be interpreted as an invention.

What is claimed is:

1. A label printer comprising:

a print head configured to perform printing on a label sheet including a label attached to a backing sheet;

a transporting roller disposed upstream of the print head in a transport path of the label sheet, and configured to rotate in a state where the transporting roller is in contact with the label sheet to transport the label sheet downstream in the transport path;

a peeling roller disposed downstream of the print head in the transport path, and configured to rotate in a state where the peeling roller is in contact with the backing sheet, the peeling roller being configured to transport the backing sheet in a direction different from a travelling direction of the label to peel the label from the backing sheet; and a control unit configured to control rotation of the transporting roller and rotation of the peeling roller, wherein the control unit controls a current value supplied to a peeling motor such that a transport force of the peeling roller for transporting the backing sheet is not smaller than a minimum force required for peeling the label and is not greater than a maximum friction force between the peeling roller and the backing sheet, the peeling motor being configured to rotate the peeling roller, and the maximum friction force between the peeling roller and the backing sheet and a maximum friction force between the transporting roller and the label sheet are set such that the maximum friction force between the peeling roller and the backing sheet is not greater than a transport force of the peeling roller so as to make a transport error of the label sheet by the transporting roller within an acceptable value.

2. The label printer according to claim 1, wherein a static friction coefficient between the peeling roller and the backing sheet is smaller than a static friction coefficient between the transporting roller and the label sheet.

3. The label printer according to claim 1, wherein a static friction coefficient between the peeling roller and the backing sheet is from 0.1 to 0.3.

* * * * *